United States Patent [19]

Woelfle

[11] Patent Number: 4,963,717

[45] Date of Patent: Oct. 16, 1990

[54] GLOW PLUG FOR INTERNAL COMBUSTION ENGINE

[75] Inventor: Serge Woelfle, Brussels, Belgium

[73] Assignee: Champion Spark Plug Europe S.A., Diegem, Belgium

[21] Appl. No.: 333,529

[22] Filed: Apr. 4, 1989

[30] Foreign Application Priority Data

Apr. 6, 1988 [GB] United Kingdom ..... 8807983

[51] Int. Cl.[5] ..... H05B 3/00; F02P 19/02; F23Q 7/00; H01C 1/03

[52] U.S. Cl. ..... 219/270; 123/145 A; 219/544; 219/553; 338/238; 361/266

[58] Field of Search ..... 219/270, 544, 553, 260–269, 219/552; 338/238–242; 123/145 R, 145 A; 361/266

[56] References Cited

U.S. PATENT DOCUMENTS 2,672,546 3/1954 Klingner et al. .
4,200,077 4/1980 Kauhl et al. ..... 123/145 A

FOREIGN PATENT DOCUMENTS 0098035 8/1984 European Pat. Off. .
2637464 2/1978 Fed. Rep. of Germany .
2014063 2/1979 United Kingdom .

*Primary Examiner*—Anthony Bartis
*Attorney, Agent, or Firm*—MacMillan, Sobanski & Todd

[57] ABSTRACT

A glow plug including a shell provided with an axially extending bore and a tubular sheath partially located in the bore and partially projecting from the shell. At least a first electrical resistance is located in the portion of the sheath extending outside the shell. The tubular sheath is filled with two different powders. Both powders have good electrical insulating characteristics. The first powder is located in the free closed end of the sheath and has good thermal conductivity characteristics. The second powder is located in the portion of the sheath located in the shell bore and has good thermal insulating characteristics. The interface between the two powders can be varied with the design of the glow plug and the type of resistance located in the sheath.

11 Claims, 3 Drawing Sheets

FIG. 5
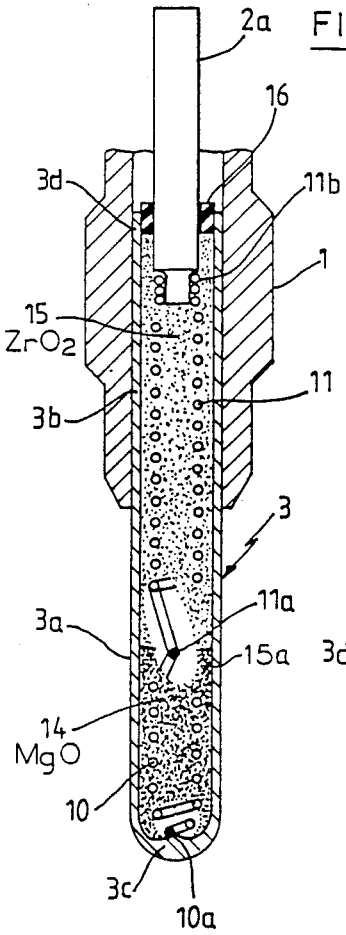
FIG. 4
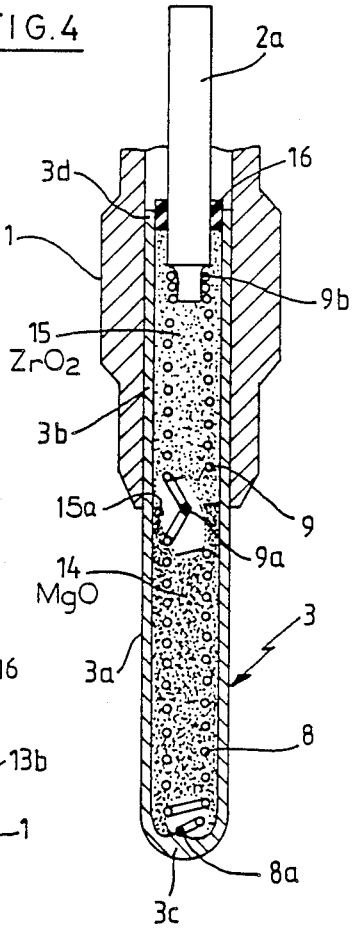
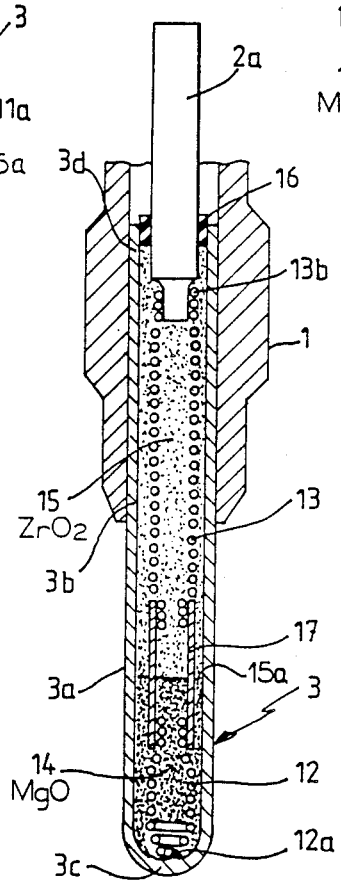
FIG. 6

GLOW PLUG FOR INTERNAL COMBUSTION ENGINE

TECHNICAL FIELD

The present invention relates to a glow plug for an internal combustion engine of the type comprising an outer shell provided with an axially extending bore, an elongated electrically conductive tubular sheath of which a first portion is located inside said bore and of which a second portion is closed at a free end which projects from the outer shell, and further comprising at least one electrical resistance located in said tubular sheath and electrically connected at one of its ends to an electrode and at the other of its ends to the free closed end of the tubular sheath.

BACKGROUND ART

Glow plugs are well, known in the prior art and it is also well known by those skilled in the art that an electrical resistance or resistances are generally embedded in an electrically insulating powder, so as to be electrically insulated from the tubular sheath they are located in, except for electrical connection with the free closed end of said tubular sheath. It is further known in prior art that in glow plugs using one single electrical resistance, the resistance may have positive temperature coefficient characteristics (PTC characteristics) and that in glow plugs using two in series connected electrical resistances the resistance which is connected to the electrode of the glow plug has higher PTC characteristics than the resistance which is connected to the free closed end of the tubular sheath.

Prior art glow plugs of the above described type using one single electrical resistance are for example disclosed in U.S. Pat. Nos. 4,477,717 and 4,639,712 whilst prior art glow plugs using two electrical resistances are for example disclosed in U.S. Pat. Nos. 4,423,309 and 4,582,980. In these four patents, and generally in the prior art, the electrical resistance or resistances located in the tubular sheath are totally embedded in one single electrically insulating powder, even if the powder may be composed of a mixture of several different materials. The powder not only has good electrically insulating characteristics, but also has good thermal conductivity characteristics. The good thermal conductivity characteristics of the powder used in prior art are necessary for the rapid transfer of the heat produced by the electrical resistance or resistances to the exterior of the tubular sheath of the glow plug. However, the use of one single powder does not permit the optimization of one of the main qualities a glow plug for modern engines must have, i.e. a rapid increase of the temperature of the free closed end portion of the tubular sheath of the glow plug.

DISCLOSURE OF INVENTION

The object of the invention is to provide a glow plug for internal combustion engines wherein the increase of the temperature of the free closed end portion of the tubular sheath of the glow plug is optimized. For reaching this object the glow plug according to the invention is substantially characterized by the fact that the portion of the tubular sheath which is nearest to its free closed end is filled with a first electrically insulating powder having good thermal conductivity characteristics and that the portion of the tubular sheath which is nearest to the electrode of the glow plug is filled with a second electrically insulating powder having good thermal insulating characteristics. Further features of the glow plug according to the invention are for example that:

the first powder preferably is magnesium oxide (MgO) and the second powder preferably is stabilized zirconium oxide ($ZrO_2$), and the electrical resistance or resistances are helically wound wires.

The position of the separating surface between the two powders in the tubular sheath of a glow plug according to the invention depends on the general structure of the glow plug, i.e. on the position of the electrical resistance or resistances in the tubular sheath and on the use of one single or of two series connected electrical resistances. When one single electrical resistance is used the separating surface between the two powders can either be located in the projecting second portion of the tubular sheath or it can be located in the first portion of the tubular sheath retained in the shell bore. When two series connected electrical resistances are used, the separating surface between the two powders preferably passes through the connecting point between the two resistances. In a particular embodiment an electrically conductive separating element can be provided between the two series connected electrical resistances. In this case the separating surface between the two powders substantially passes through the geometrical center of the separating element.

The invention will be better understood when reading the following portion of the description in conjunction with the appended drawings.

BRIEF DESCRIPTION OF THE DRAWINGS

FIG. 4 is a vertical fragmentary cross sectional view of a glow plug according to a further modified embodiment of the invention;

FIG. 5 is a vertical fragmentary cross sectional view of a glow plug according to a further modified embodiment of the invention;

FIG. 6 is a vertical fragmentary cross sectional view of a glow plug according to still a further modified embodiment of the invention.

BEST MODE FOR CARRYING OUT THE INVENTION

Figure 1:
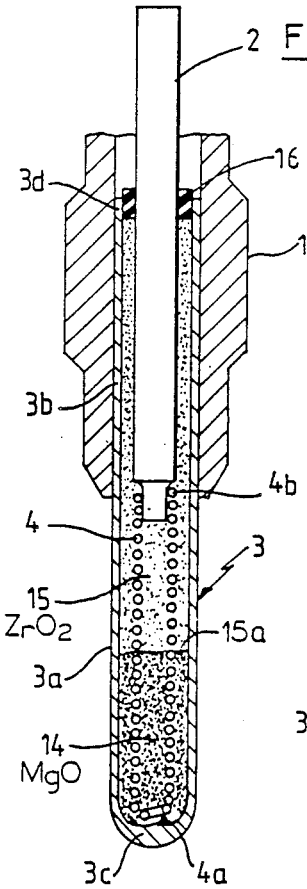
FIG. 1 is a vertical fragmentary cross sectional view of a glow plug according to a first embodiment of the invention.

All seven embodiments of the glow plug according to the invention shown in FIGS. 1 through 7 comprise an outer shell 1, an electrode 2 (or 2*a*) and an elongated electrically conductive tubular sheath 3. The sheath 3 has a first portion 3*b* partially located in an axial bore of the shell 1 and a second portion 3*a* partially projecting from the shell 1. Depending on the embodiment, one or two electrical resistances (4, 5, 6, 7, etc.) are located in said electrically conductive tubular sheath 3. In the embodiments wherein two electrical resistances are provided (FIGS. 3 through 6) the resistances are electrically connected in series. In each of the six embodiments of the invention the second portion 3*a* of the tubular sheath 3 is closed at a free end 3*c* and the tubular sheath 3 is partially filled with a first powder 14 and is partially filled with a second powder 15. The first powder 14 and the second powder 15 are separated at a surface 15*a*. An open end portion 3*d* of the tubular sheath 3 which is located in the axial bore of the shell 1 is sealed by an appropriate seal 16. Both powders 14, 15 have good electrical insulating characteristics, but moreover the first powder 14 has good thermal conductivity characteristics and the second powder 15 has good thermal insulating characteristics. As already stated above, the powder 14, for example, can be magnesium oxide (MgO) and the powder 15 can be stabilized zirconium oxide ($ZrO_2$).

In all seven embodiments of the glow plug according to the invention the electric current flows from the electrode 2 (or 2*a*) through the electrical resistance or resistances (4, 5, 6, 7, etc.) and then back through the tubular sheath 3 to the shell 1 (earth). Indeed, the electrical resistance or resistances (4, 5, 6, 7, etc.) are respectively electrically connected to the electrode 2 (or 2*a*) at reference numerals 4*b*, 5*b*, 6*b*, 7*b*, etc. and to the closed free end 3*c* of the tubular sheath 3 at reference numerals 4*a*, 5*a*, 6*a*, etc.

The glow plug of FIG. 1 has one single electrical resistance 4. The separating surface 15*a* between the two powders 14, 15 is located in the second portion 3*a* of the tubular sheath 3.

Figure 2:
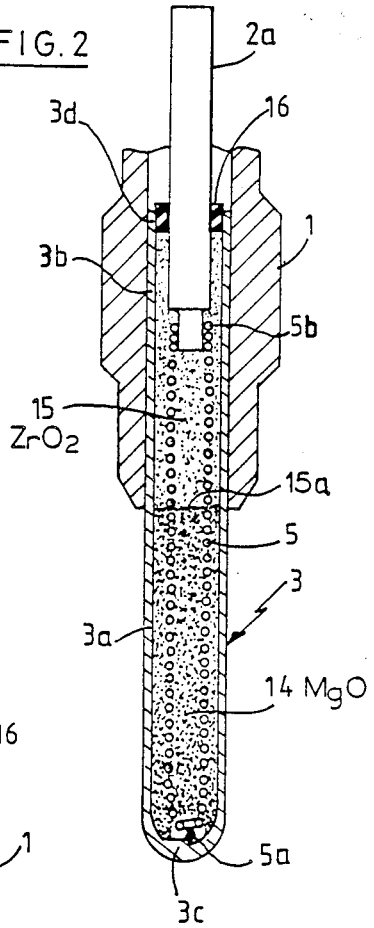
FIG. 2 is a vertical fragmentary cross sectional view of a glow plug according to a modified embodiment of the invention.

The glow plug of FIG. 2 also has one single electrical resistance 5, but the separating surface between the two powders 14, 15 is located in the plane where the second portion 3*a* of the tubular sheath 3 projects from the shell 1.

Figure 3:
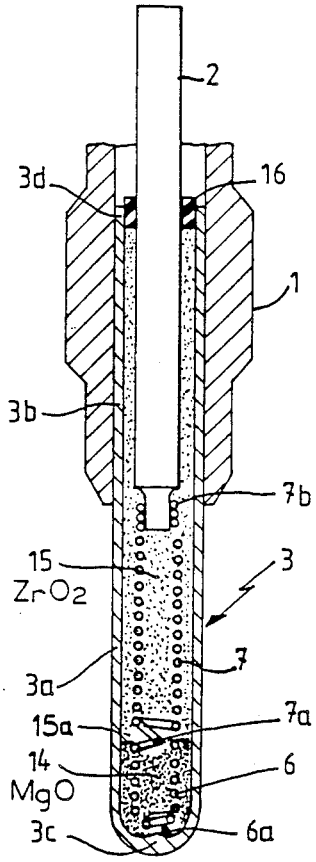
FIG. 3 is a vertical fragmentary cross sectional view of a glow plug according to a further modified embodiment of the invention.

The glow plug of FIG. 3 has two series connected electrical resistances 6, 7 located in the second portion 3*a* of the tubular sheath 3. The separating surface 15*a* between the two powders 14, 15 passes through the connecting point 7*a* between the two resistances 6, 7.

The glow plug of FIG. 4 has a first electrical resistance 9 completely located in the first portion 3*b* of the tubular sheath 3 and a second electrical resistance 8 completely located in the second portion 3*a* of the tubular sheath 3. The separating surface 15*a* between the two powders 14, 15 is located in the plane where the second portion 3*a* of the tubular sheath 3 projects from the shell 1.

The glow plug of FIG. 5 has two series connected electrical resistances 10, 11. A first of the resistances 11 is partially located in the first portion 3*b* of the tubular sheath 3 and partially located in the second portion 3*a* of the tubular sheath 3 and the second of the resistances 10 is completely located in the second portion 3*a* of the tubular sheath 3. The separating surface 15*a* between the two powders 14, 15 passes through the connecting point 11*a* between the two resistances 10, 11.

Figure 7:
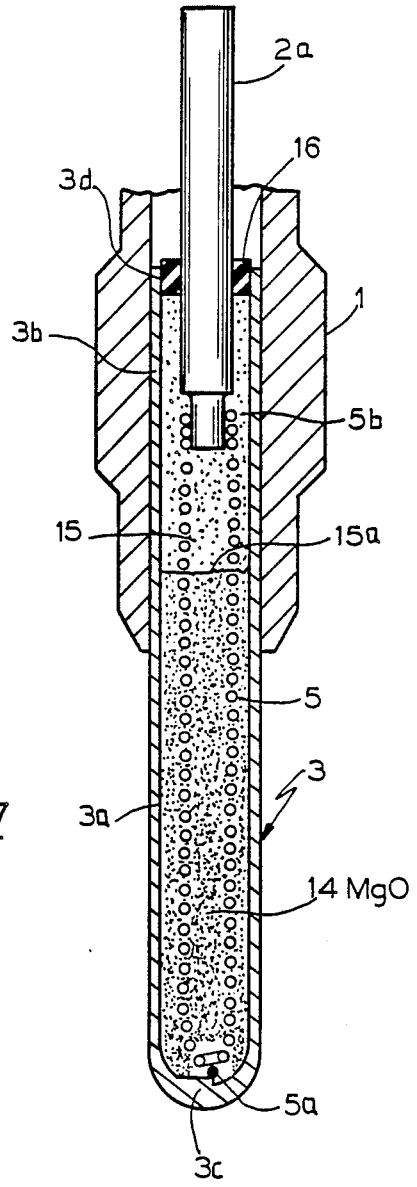
FIG. 7 is a vertical fragmentary cross sectional view of a glow plug according to still a further modified embodiment of the invention.

The glow plug of FIG. 6 has two series connected electrical resistances 12, 13. A first of the resistances 13 is partially located in the first portion 3*b* of the tubular sheath 3 and partially located in the second portion 3*a* of the tubular sheath 3 and the second of the resistances 12 is completely located in the second portion 3*a* of the tubular sheath 3. An electrically conductive separating element 17 is located between the two resistances 12, 13. The separating surface 15*a* between the two powders 14, 15 substantially passes through the geometrical center of the separating element 17. In FIG. 6 the separating element 17 is an elongated tube and it is further to be noted that the electrical resistance 13 could be located completely in the first portion 3*b* of the tubular sheath 3. The glow plug of FIG. 7 is similar to the glow plug of FIG. 2, except that the separating surface 15*a* between the first powder 14 and the second powder 15 is located in the first portion 3*b* of the tubular sheath 3 located within the shell 1.

As stated above, in similar prior art glow plugs the tubular sheath of the plug is filled with only one electrically insulating powder. This powder must also have good thermal conductivity characteristics since it must rapidly transfer heat from a single electrical resistance or heat from one of two electrical resistances to the free closed end portion of the sheath. The consequence of the use of one single powder having good thermal conductivity characteristics is that a significant portion of the heat produced by the electrical resistance or resistances is dissipated through the shell of the plug to the body of the engine. Indeed, in the most prior art glow plugs of the type having only a single electrical resistance (similar to the structure of FIG. 2) a good portion of the electrical resistance is located inside the shell of the plug. In most prior art glow plugs of the type having two series connected electrical resistances (similar to the structures of FIGS. 4 through 6) one of the two resistances is either completely or at least partially located inside the shell of the plug.

In glow plugs according to the invention the use of a second powder 15 having good thermal insulating characteristics substantially reduces this useless dissipation of the heat produced by the electrical resistance or resistances. Indeed in the case of a single resistance 4, 5, an important portion of the resistance is embedded in the thermally insulating powder 15 and in the case of two resistances (FIG. 3 through 6) one resistance is completely embedded in the thermally insulating powder 15. Since the heat produced by a portion of a single electrical resistance (4, 5) or by one of two electrical resistances (9, 11, 13) is not uselessly dissipated, such heat contributes to the rapid heating of the resistances and of the second portion 3*a* of the glow plug sheath 3 according to the invention.

In other words, since in a glow plug provided with one single electrical resistance, the resistance (4, 5) preferably has PTC characteristics. The final heating temperature and the self-stabilizing effect of the plug according to the invention will be obtained more rapidly than in a prior art glow plug provided with only one single powder. The same is true for a glow plug provided with two in series connected electrical resistances, in particular also because the resistance (9, 11, 13) which is completely embedded in the thermal insulating powder 15 has higher PTC characteristics than the resistance (8, 10, 12) which is embedded in the powder 14, i.e. the powder which has good thermal conductivity characteristics.

It is to be noted that in FIG. 1 the portion of the electrical resistance 4, which is embedded in the thermal insulating powder 15, is located outside the shell 1 and that in FIG. 3 the electrical resistance 7, which is embedded in the same thermal insulating powder 15, is also located outside the shell 1. These two particular configurations do however not change, as to its principle, the above mentioned result of the glow plug according to the invention, i.e. that the use of two powders having different thermal conductivity characteristics permits a faster heat up of the plug and, when it reaches its operating temperature, it will self-stabilize more rapidly than prior art glow plugs.

What is claimed:

1. A glow plug for an internal combustion engine comprising an outer electrically conductive shell provided with an axially extending bore, an elongated electrically conductive tubular sheath having a first open end portion located inside said bore in electrical contact with said shell and a second portion closed at a free end projecting from said shell bore, an electrode extending into said pen sheath end and electrically insulated from said shell and said sheath, and further comprising at least one electrical resistance located in said tubular sheath and having a first end electrically connected to said electrode and a second end electrically connected to the free closed end of said tubular sheath, characterized in that the portion of said tubular sheath which is nearest to said free closed end is filled with a first electrically insulating thermally conductive powder and that the portion of said tubular sheath which is nearest to said electrode is filled with a second electrically insulating powder, said second powder having a substantially lower thermal conductivity than said first powder.

2. A glow plug according to claim 1, characterized in that said first powder is MgO and that said second powder is stabilized $ZrO_2$.

3. A glow plug according to claim 1 wherein said at least one electrical resistance comprises a single electrical resistance, wherein said first and second powders contact at a separating surface, and further characterized in that said separating surface between said first and second powders is located in said second portion of said tubular sheath.

4. A glow plug according to claim 1, wherein said at least one electrical resistance comprises a single electrical resistance, wherein said first and second powders contact at a separating surface and further characterized in that said separating surface between said two powders is located in said first portion of the tubular sheath.

5. A glow plug according to claim 1, wherein said first and second powders contact at a separating surface, wherein said at least one electrical resistance comprises two series connected electrical resistances located in said second portion of said tubular sheath, and further characterized by said separating surface between said two powders passing through the connection between said two resistances.

6. A glow plug according to claim 5, wherein said two electrical resistances are helically wound wires.

7. A glow plug according to claim 1 wherein said at least one electrical resistance comprises a first electrical resistance completely located in said first portion of said tubular sheath and a second electrical resistance completely located in said second portion of said tubular sheath, wherein said first and second powders contact at a separating surface and further characterized in that said separating surface between said two powders is located substantially in the plane where said second portion of the tubular sheath projects from said outer shell.

8. A glow plug according to claim 1, wherein said first and second powders contact at a separating surface, wherein said at least one electrical resistance comprises two series connected electrical resistances, wherein a first of said resistances is partially located in said first portion of said tubular sheath and partially located in said second portion of said tubular sheath and the second of said resistances is completely located in said second portion of the tubular sheath, and further characterized by the separating surface between said two powders passing through the connecting point between said two resistances.

9. A glow plug according to claim 1, wherein said first and second powders contact at a separating surface, wherein said at least one electrical resistance comprises two series connected electrical resistances, wherein at least a portion of a first of said resistances is located in said first portion of said tubular sheath and the second of said resistances is completely located in said second portion of said tubular sheath, and further characterized by an electrically conductive separating element located between said two resistances, said separating element electrically connecting said resistances in series, and wherein said separating surface between said two powders substantially passes through the geometrical center of said separating element.

10. A glow plug according to claim 9, wherein said electrically conductive separating element is an elongated tube.

11. A glow plug according to claim 1 wherein said at least one electrical resistance is a helically wound wire.

* * * * *

UNITED STATES PATENT AND TRADEMARK OFFICE

CERTIFICATE OF CORRECTION

PATENT NO. : 4,963,717

DATED : October 16, 1990

INVENTOR(S) : Serge Woelfle

It is certified that error appears in the above-identified patent and that said Letters Patent is hereby corrected as shown below:

Column 5, line 12, change "pen" to -- open --.

Signed and Sealed this

Third Day of March, 1992

*Attest:*

HARRY F. MANBECK, JR.

*Attesting Officer*

*Commissioner of Patents and Trademarks*